US008919611B2

(12) United States Patent
Ophardt et al.

(10) Patent No.: US 8,919,611 B2
(45) Date of Patent: Dec. 30, 2014

(54) ADAPTIVE PRELOAD PUMP

(71) Applicant: Gotohti.com Inc., Beamsville (CA)

(72) Inventors: Heiner Ophardt, Arisdorf (CH); Andrew Jones, Smithville (CA)

(73) Assignee: Gotohti.com, Beamsville (CA)

( * ) Notice: Subject to any disclaimer, the term of this patent is extended or adjusted under 35 U.S.C. 154(b) by 69 days.

(21) Appl. No.: 13/794,361

(22) Filed: Mar. 11, 2013

(65) Prior Publication Data

US 2014/0091106 A1 Apr. 3, 2014

(30) Foreign Application Priority Data

Mar. 20, 2012 (CA) ..... 2772507

(51) Int. Cl.

| | |
|---|---|
| ***B67D 7/06*** | (2010.01) |
| ***F04B 23/02*** | (2006.01) |
| ***A47K 5/12*** | (2006.01) |
| ***B05B 11/00*** | (2006.01) |

(52) U.S. Cl.

CPC ..... *F04B 23/028* (2013.01); *A47K 5/1207* (2013.01); *B05B 11/3001* (2013.01); *B05B 11/3097* (2013.01)

USPC ..... 222/181.3; 222/321.8

(58) Field of Classification Search

USPC ..... 222/181.3, 321.1, 321.7–321.9, 383.1, 222/383.3

See application file for complete search history.

(56) References Cited

U.S. PATENT DOCUMENTS

| | | | | |
|---|---|---|---|---|
| 5,975,360 | A | 11/1999 | Ophardt | |
| 6,446,840 | B2 | 9/2002 | Ophardt et al. | |
| 6,557,736 | B1 | 5/2003 | Ophardt | |
| 7,267,251 | B2 | 9/2007 | Ophardt | |
| 7,303,099 | B2 | 12/2007 | Ophardt | |
| 7,337,930 | B2 | 3/2008 | Ophardt et al. | |
| RE40,319 | E | 5/2008 | Ophardt et al. | |
| 7,959,037 | B2 | 6/2011 | Ophardt et al. | |
| 8,056,772 | B2 | 11/2011 | Ophardt et al. | |
| 8,157,134 | B2 | 4/2012 | Ophardt et al. | |
| 8,272,539 | B2 | 9/2012 | Ophardt et al. | |
| 8,360,286 | B2 | 1/2013 | Shi et al. | |
| 8,365,965 | B2 | 2/2013 | Ophardt | |
| 8,413,855 | B2 | 4/2013 | Ophardt | |
| 2004/0217137 | A1* | 11/2004 | Ophardt | 222/481.5 |
| 2005/0205600 | A1* | 9/2005 | Ophardt et al. | 222/1 |
| 2005/0276707 | A1* | 12/2005 | Ophardt | 417/437 |
| 2007/0023454 | A1* | 2/2007 | Ophardt | 222/190 |
| 2007/0257064 | A1 | 11/2007 | Ophardt | |
| 2007/0284394 | A1 | 12/2007 | Ophardt | |
| 2010/0260632 | A1 | 10/2010 | Ophardt et al. | |
| 2011/0014076 | A1* | 1/2011 | Shi et al. | 417/559 |
| 2011/0240680 | A1 | 10/2011 | Ophardt et al. | |
| 2012/0104051 | A1 | 5/2012 | Ophardt et al. | |

* cited by examiner

*Primary Examiner* — Paul R Durand
*Assistant Examiner* — Donnell Long
(74) *Attorney, Agent, or Firm* — Thorpe North & Western LLP

(57) ABSTRACT

A piston pump dispenser having a reciprocating piston pump arrangement in which in a dispensing stroke in which fluid is pressurized in a chamber to dispense fluid, a piston slide member is urged into a sealing disc of a piston sleeve member to increase the extent to which the sealing disc provides a seal with a wall of the chamber against fluid leaking out past the seal disc.

20 Claims, 9 Drawing Sheets

ADAPTIVE PRELOAD PUMP

SCOPE OF THE INVENTION

This invention relates to piston pumps and, more particularly, piston pumps in which a flexible seal on a piston engages with a chamber wall to maintain pressure within a chamber by which fluid is pumped from the chamber.

BACKGROUND OF THE INVENTION

Many known piston pumps such as that disclosed in U.S. Pat. No. 5,975,360 to Ophardt, issued Nov. 2, 1999, have a piston which is coaxially slidable in a chamber with engagement between a radially outwardly extending disc on the piston and a wall of the chamber forming a seal which prevents fluid flow between the disc and the chamber wall inwardly and/or outwardly for proper operation of the piston. Many known such pumps suffer the disadvantage that the extent to which such a seal prevents fluid flow therepast is a function of the relative diameter of the disc and the chamber in which the disc is received as well as the inherent resiliency of the disc. The present applicants have appreciated the disadvantage that while a disc may upon manufacture have an adequate inherent bias into engagement with a chamber wall to prevent fluid flow therepast that, over time, the compression of such a disc in the chamber results in the material such as plastic forming the disc developing a set which reduces the inherent bias by which the disc is biased outwardly into engagement with the chamber wall increasing the risk of leakage past the seal. Providing a disc which has a strong inherent bias to engage the chamber wall has the disadvantage of increasing the forces required to move the piston. Additionally, with use of the piston, wear of the sealing surfaces on the discs may affect the extent to which seal is adequately provided.

SUMMARY OF THE INVENTION

To at least partially overcome these disadvantages of previously known devices the present invention provides a piston pump having a reciprocating piston pump arrangement in which in a dispensing stroke in which fluid is pressurized in a chamber to dispense fluid, a piston slide member is urged into a sealing disc of a piston sleeve member to increase the extent to which the sealing disc provides a seal with a wall of the chamber against fluid leaking out past the seal disc.

An object of the present invention is to provide a piston pump which resists the tendency of seals to leak.

An object of the present invention is to provide a fluid dispenser with a piston pump for dispensing fluid including a piston carrying a movable slide member which slides to reduces the tendency of a seal to leak between the piston and a piston chamber wall.

Accordingly, in one aspect the present invention provides a pump for dispensing liquid from a reservoir comprising:

a piston chamber-forming member having a chamber disposed about an axis, the chamber having a diameter, a chamber wall, an inner end and an open outer end, the inner end of the chamber in fluid communication with the reservoir, a one-way valve between the reservoir and the chamber permitting fluid flow through the inner end of said chamber, only from the reservoir to the chamber, a piston sleeve member slidably received in the chamber of the piston chamber-forming member for reciprocal axial inward and outward movement therein in a stroke of movement between an extended position and a retracted position, said sleeve member having an axially extending hollow sleeve stem having a central bore therethrough from an inner end to an outlet proximate an outer end, an outer disc on the sleeve stem and extending radially outwardly from the sleeve stem circumferentially thereabout to engage the chamber wall to form a seal therewith against fluid flow therepast, the outer disc having a cam surface annularly thereabout outwardly of the sleeve stem, a piston slide member having an axially extending hollow slide stem having a central passage closed at an inner end and open at an outer end, an inner disc on the slide stem extending radially outwardly from the slide stem circumferentially thereabout proximate the inner end of the slide stem, a spreader disc on the slide stem spaced axially outwardly from the inner disc and extending radially outwardly from the slide stem circumferentially thereabout, an inlet located on the slide stem between the inner disc and the spreader disc in communication with the passage, the slide member coupled to the sleeve member for limited coaxial sliding movement of the slide member relative the sleeve member between an extension condition and a retraction condition with the slide stem coaxially disposed relative the bore, the passage in communication with the bore and the spreader disc located in the chamber inwardly of the outer disc, the inner disc engaging the chamber wall axially inwardly of the spreader disc to substantially prevent fluid flow in the chamber past the inner disc in an inward direction but with the inner disc elastically deforming away from the chamber wall to permit fluid flow in the chamber past the inner disc in an outward direction, the spreader disc having a camming surface in opposition to the cam surface of the outer disc, in the extension condition the camming surface of the spreader disc is axially spaced from the cam surface of the outer disc, in the retraction condition the camming surface of the spreader disc engaging the cam surface of the outer disc to urge the edge portion of the outer disc radially outwardly into the chamber wall.

Preferably, in such a pump, a cycle of operation comprises moving in a retraction stroke from the extended position to the retracted position and moving in an extension stroke from the retracted position to the extended position, in the extension stroke a vacuum is created in the chamber between the inner disc and the one-way valve by which both (a) the slide member is moved relative the sleeve member to the extension condition and (b) fluid is drawn from the reservoir past the one-way valve to between the inner disc and the one-way valve, in the retraction stroke pressure is created in the chamber between the inner disc and the one-way valve by which both (a) the slide member is moved relative the sleeve member to the retraction condition and (b) fluid is discharged from between the inner disc and the one-way valve past the inner disc to between the inner disc and the outer disc and via the inlet, the passage and the bore out the outlet.

More preferably, at the end of an extension stroke and the beginning of a retraction stroke the sleeve is in the extended position with the slide in the extension condition, and at the end of a retraction stroke and the beginning of an extension stroke the sleeve is in the retracted position with the slide in the retraction condition.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
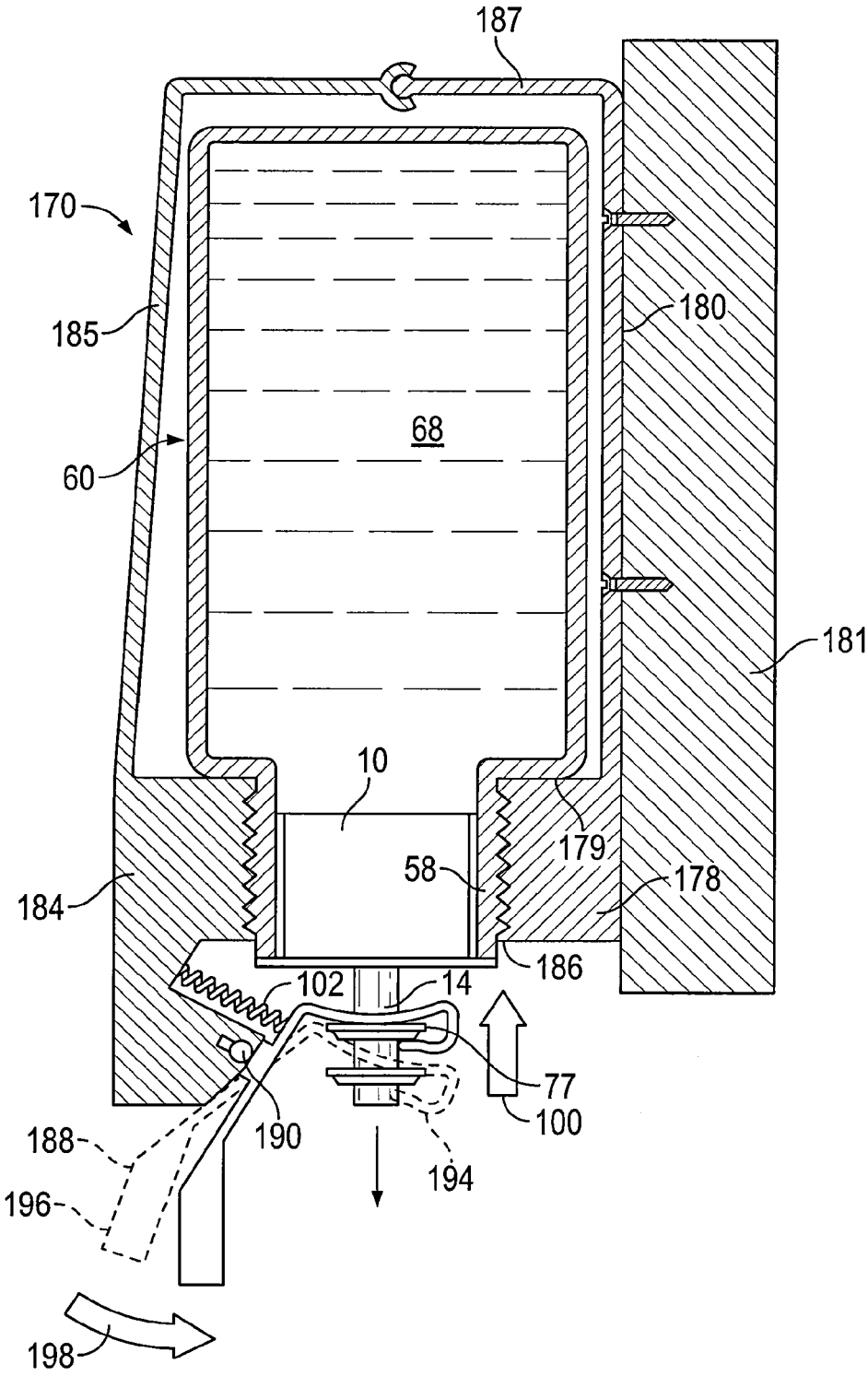
FIG. 1 is a partially cut-away side view of an embodiment of a liquid dispenser with a reservoir and a pump assembly in accordance with the present invention.

Reference is now made to FIG. 1 which shows a liquid soap dispenser generally indicated 170 utilizing a pump assembly 10 coupled to the neck 58 of a sealed, collapsible container or reservoir 60 containing liquid hand soap 68 to be dispensed. Dispenser 170 has a housing generally indicated 178 to receive and support the pump assembly 10 and the reservoir 60. Housing 178 is shown with a back plate 180 for mounting the housing, for example, to a building wall 181. A bottom support plate 184 extends forwardly from the back plate to support and receive the reservoir 60 and pump assembly 10. The pump assembly 10 is only schematically shown in FIG. 1, as including a slidable piston 14. As shown, bottom support plate 184 has a circular opening 186 therethrough. The reservoir 60 sits supported on shoulder 179 of the support plate 184 with the neck 58 of the reservoir 60 extending through opening 186 and secured in the opening as by a friction fit, clamping and the like. A cover member 185 is hinged to an upper forward extension 187 of the back plate 180 so as to permit replacement of reservoir 60 and its pump assembly 10.

Support plate 184 carries at a forward portion thereof an actuating lever 188 journalled for pivoting about a horizontal axis at 190. An upper end of the lever 188 carries a hook 194 to engage an engagement disc 77 carried on the piston 14 of the piston pump 10 and couple the lever 188 to piston 14 such that movement of the lower handle end 196 of lever 188 from the dashed line position to the solid line position, in the direction indicated by arrow 198 slides piston 14 inwardly in a retraction or discharge pumping stroke as indicated by arrow 100. On release of the lower handle end 196, a spring 102 biases the upper portion of lever 188 downwardly so that the lever draws piston 14 outwardly to a fully withdrawn position as seen in dashed lines in FIG. 1. Lever 188 and its inner hook 194 are adapted to permit manual coupling and uncoupling of the hook 194 as is necessary to remove and replace reservoir 60 and pump assembly 10. Other mechanisms for moving the piston 14 can be provided including mechanised and motorized mechanisms.

In use of the dispenser 170, once exhausted, the empty, collapsed reservoir 60 together with the attached pump assembly 10 are preferably removed and a new reservoir 60 and attached pump assembly 10 may be inserted into the housing.

Reference is made to FIGS. 2, 3, 4 and 5 which schematically illustrate a pump assembly 10 in accordance with a first embodiment of the present invention generally adapted to be used as the pump assembly 10 shown in FIG. 1.

The pump assembly 10 comprises three principle elements, a piston chamber-forming body 12, a piston-forming element or piston 14 comprising a piston sleeve member 100 and a piston slide member 120 and a one-way inlet valve 16. The body 12 carries an outer annular flange 13 with internal threads 15 which are adapted to engage threads of the neck 58 of a bottle 60 shown in dashed lines only in FIG. 2 which is to form the fluid reservoir.

The body 12 includes an interior center tube 17 which provides a cylindrical chamber 18 which has a chamber wall 21, an inner end 22 and an outer end 26.

An inlet 34 to the chamber 18 is provided in the inner end 22 of the chamber 18 as an outlet of an inlet tube 35 extending inwardly from the inner end 22 of the chamber 18 to an inner end 36 in communication with the bottle 60. A flange 37 extends across the inlet tube 35 having a central opening 38 and a plurality of inlet openings 39 therethrough. The one-way valve 16 is disposed across the inlet openings 39. The inlet openings 39 provide communication through the flange 37 with fluid in the bottle 60. The one-way valve 16 permits fluid flow from the bottle 60 into the chamber 18 but prevents fluid flow from the chamber 18 to the bottle 60.

The one-way valve 16 comprises a shouldered button 40 which is secured in snap-fit relation inside the central opening 38 in the flange 37 with a circular resilient flexing disc 41 extending radially from the button 40. The flexing disc 41 is sized to circumferentially abut a cylindrical wall 42 of the inlet tube 35 substantially preventing fluid flow there past from the chamber 18 to the bottle 60. The flexing disc 41 is deflectable away from the wall 42 to permit flow from the bottle 60 through the inlet tube 35 into the chamber 18.

The piston 14 is axially slidably received in the chamber 18 for reciprocal sliding motion inward and outwardly therein. The piston 14 is generally circular in cross-section about a central longitudinal axis 23 through the piston. The piston 14 comprises two relatively slidable elements, namely an outer piston portion being the sleeve member 100 and an inner piston portion being the slide member 120.

The sleeve member 100 has a hollow sleeve stem 101 with a sleeve stem wall 102 about a central coaxially bore 103 of the sleeve member 100 and open at an inner end 104 and at an outlet 76 at an outer end 105. The sleeve member 100 carries an outer disc 73 which extends radially outwardly from the sleeve stem 101 proximate the inner end 104 of the sleeve member 100. The outer disc 73 is a circular disc. The outer disc 73 extends radially outwardly on the sleeve stem 101 to circumferentially engage the chamber wall 21. The outer disc 73 is sized to circumferentially abut the chamber wall 21 to substantially prevent fluid flow therebetween outwardly. The outer disc 73 is biased radially outwardly and carries resilient edge portion with a radially outwardly directed surface for engagement with the chamber wall 21 of the chamber 18 to prevent fluid flow therepast. The outer disc 73 is generally frustoconical with an axially inwardly and radially inwardly directed inner cam surface 99. Preferably, the outer disc 73 engages the chamber wall 21 to prevent flow there past both inwardly and outwardly.

Figure 2:
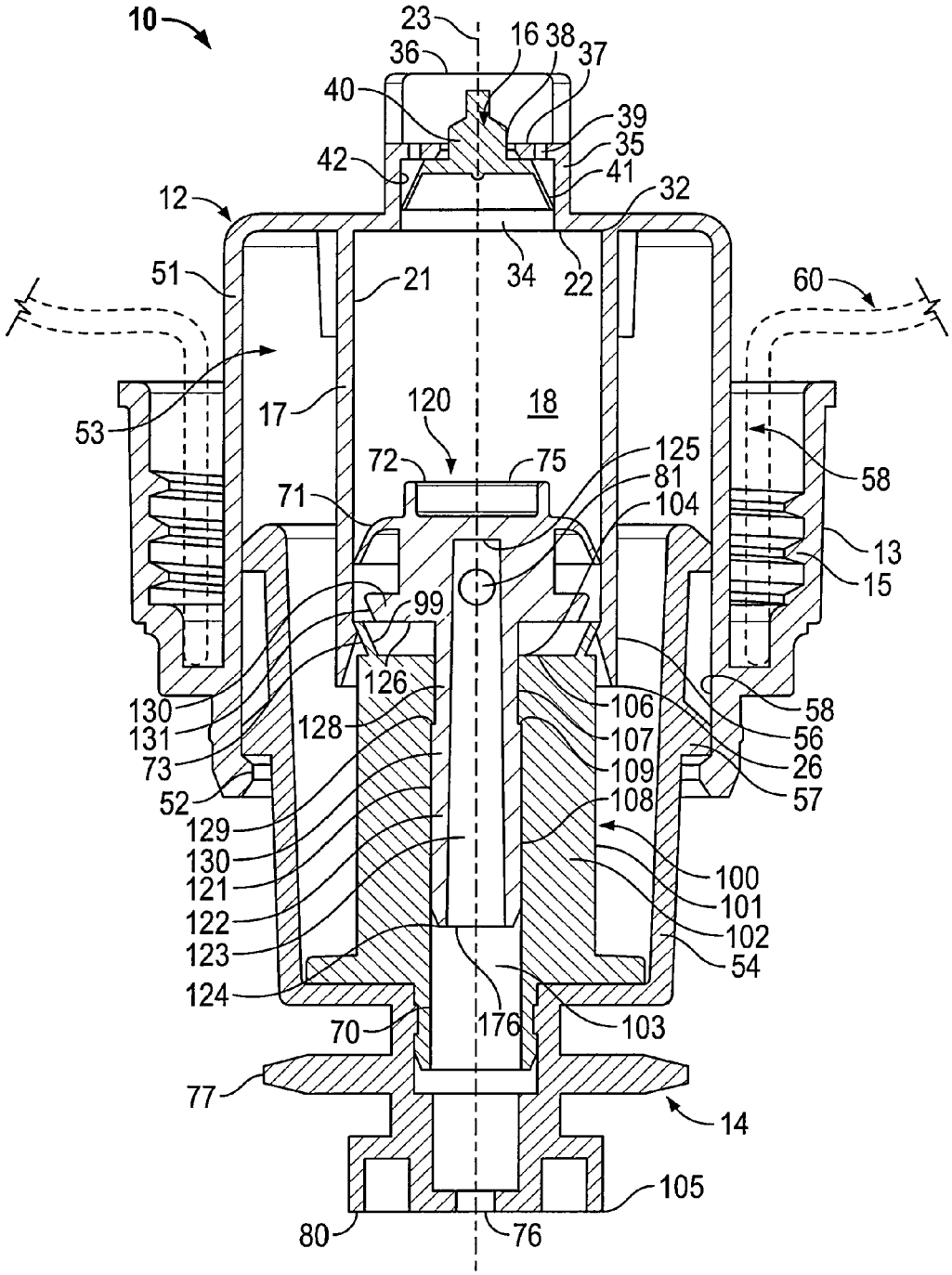
FIG. 2 is a schematic cross-sectional side view of a pump assembly in accordance with a first embodiment of the present invention at the end of an extension stroke with a piston sleeve member in a fully extended position and a piston slide member in an extension condition.
Figure 4:
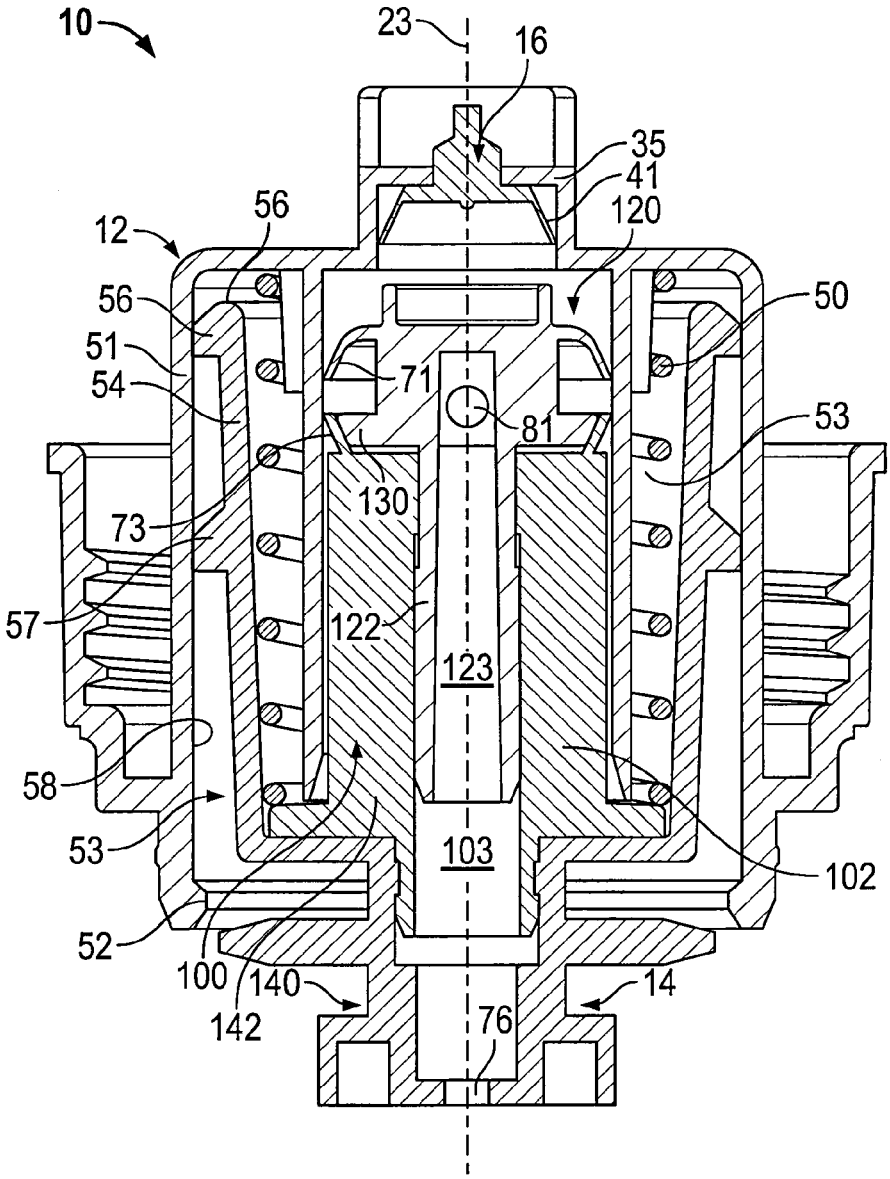
FIG. 4 is a view identical to that in FIG. 2 but at the end of a retraction stroke with the piston sleeve member in a fully retracted position and the slide member in a retraction condition.

The sleeve member 100 is slidably received in the chamber 18 of the body 12 for reciprocal axial inward and outward movement therein in a stroke of movement between a fully extended position shown in FIG. 2 and the fully retracted position shown in FIG. 4.

Figure 3:
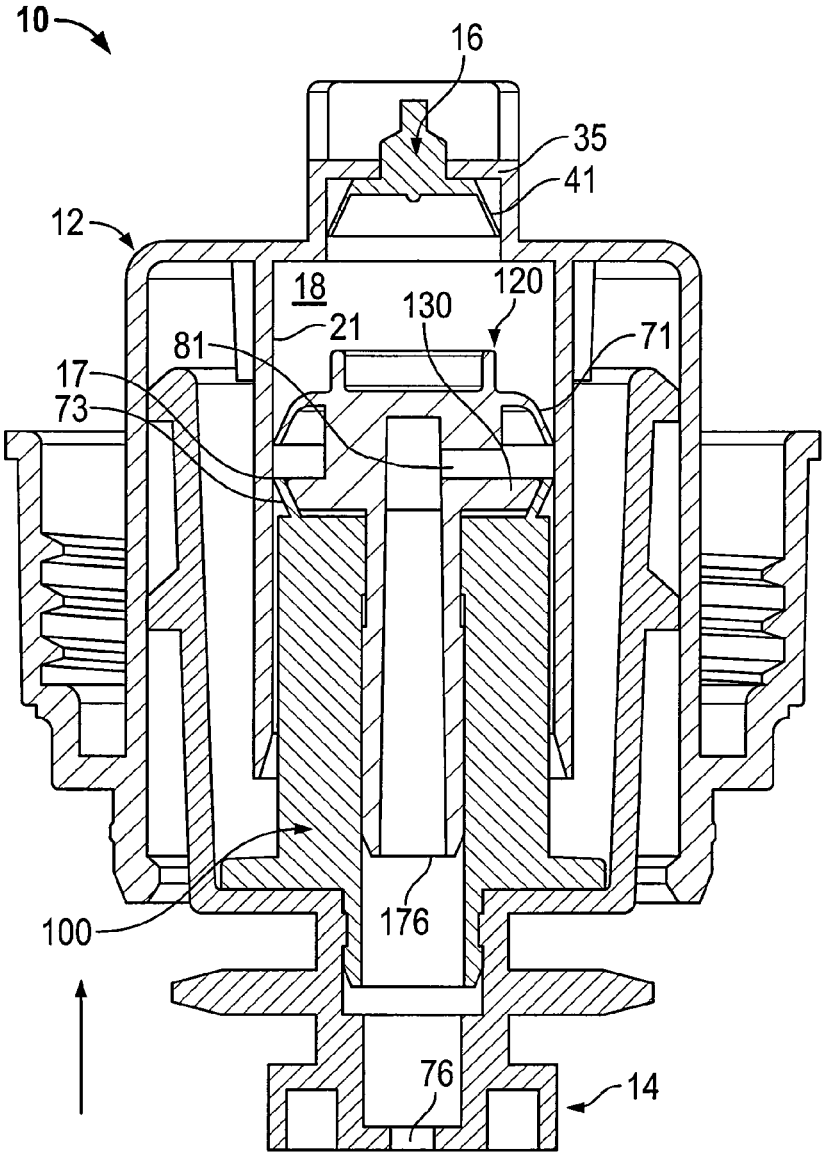
FIG. 3 is a view identical to that in FIG. 2 but during a retraction stroke with the piston sleeve member in an intermediate position between the fully extended position and the fully retracted position and the piston slide member in a retraction condition.

In movement of the sleeve member 100 in a retraction stroke between the extended position of FIG. 2 and the retracted position of FIG. 4, the sleeve member 100 assumes the intermediate position shown in FIG. 3. In movement of the sleeve member 100 in an extension stroke between the retracted position of FIG. 4 and the extended position of FIG. 2, the sleeve member 100 assumes the intermediate position shown in FIG. 5.

The slide member 120 has a hollow slide stem 121 with a slide stem wall 122 about a central passage 123 closed at an inner end 125 and open at an outer end 124 forming a slide outlet 176.

The slide member 120 carries two discs which extend radially outwardly from the slide stem, namely, an inner disc 71 and a spreader disc 130. The spreader disc 130 is located on the slide member 120 spaced axially outwardly from the inner disc 71.

The inner disc 71 is a circular resilient flexing disc located proximate an inner end 72 of the slide member 120 and extending radially therefrom. The inner disc 71 extends radially outwardly on the stem 70 to circumferentially engage the chamber wall 21. The inner disc 71 is sized to circumferentially abut the chamber wall 21 to substantially prevent fluid flow therebetween inwardly. The inner disc 71 is biased radially outwardly, however, is adapted to be deflected radially inwardly so as to permit fluid flow past the inner disc 71 outwardly.

A channel 81 extends radially from an inlet located on the side of the slide stem 121 between the inner disc 71 and the spreader disc 130 inwardly through the slide stem 121 into communication with the central passage 123. The channel 81 and central passage 123 permit fluid communication through the slide member 120 to the slide outlet 176 of the slide member 120.

An outer circular engagement flange 77 is provided outwardly from the outer disc 73 on an outermost end portion of the sleeve stem 101 which extends radially outwardly from the outer end 26 of the chamber 18. The flange 77 may be engaged by an actuating device, such as the lever 188 in FIG. 1, in order to move the sleeve member 100 in and out of the body 12. Axially extending webs or ribs (not shown) and radially extending circular flanges (not shown) may be provided to extend radially from the sleeve stem 101 to assist in maintaining the sleeve member 100 in axially centred and aligned arrangement when sliding into and out of the chamber 18.

The slide member 120 is coupled to the sleeve member 100 with the slide stem 121 received in the sleeve bore 103 and the spreading disc 130 of the slide member 120 in the chamber 18 axially inwardly of the outer disc 73.

Figure 5:
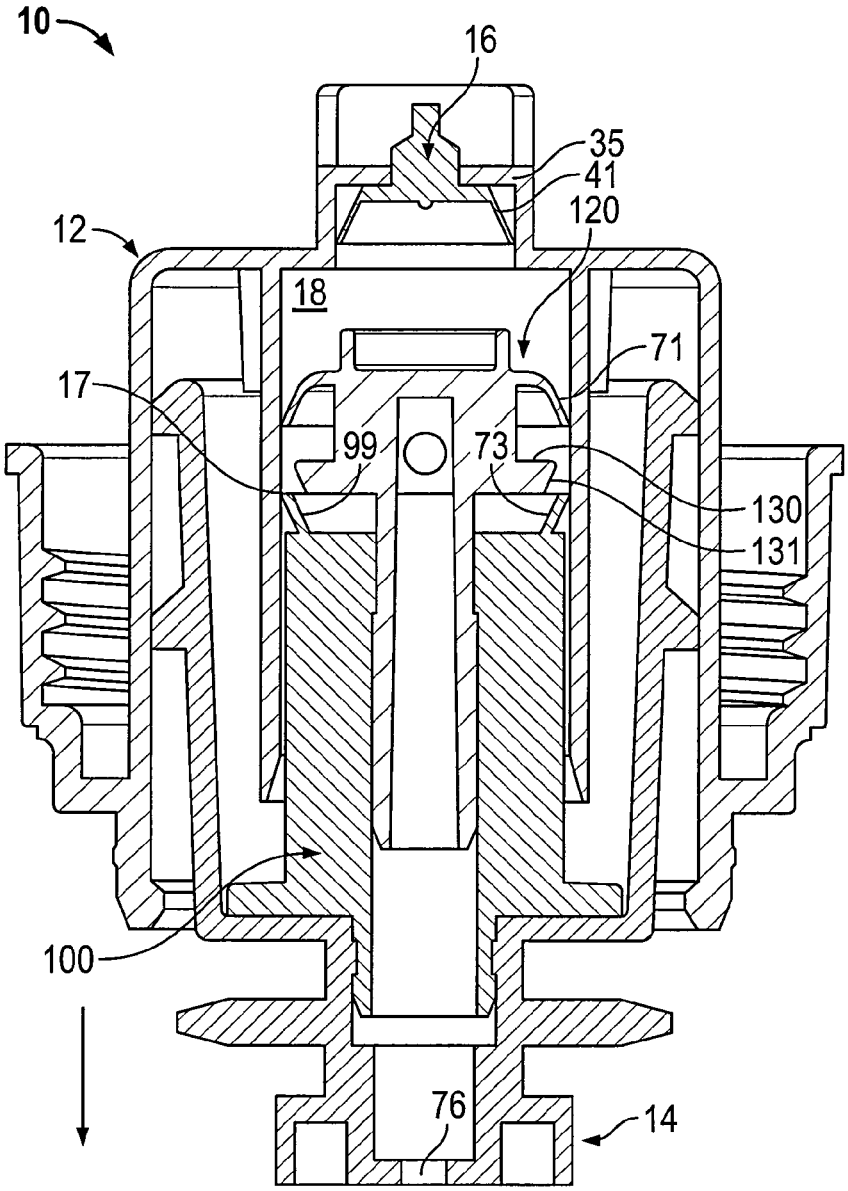
FIG. 5 is a view identical to that in FIG. 2 but during an extension stroke with the piston sleeve member in an intermediate position between the fully retracted position and the fully extended position and the piston slide member in an extension condition.

The slide member 120 is coaxially slidably coupled to the sleeve member 100 for limited coaxial sliding relative the sleeve member 100 between an extension condition shown in FIGS. 2 and 5 and a retraction condition shown in FIGS. 3 and 4.

Outwardly of the outer disc 73, the sleeve stem 101 carries as part of an inner surface of the sleeve stem wall 102, an axially inwardly directed inner stop shoulder 106 inwardly of a first ring portion 107 of the sleeve stem wall 102 of a diameter larger than a diameter of a second outer portion 108 of the sleeve stem wall 102 outward from the ring portion 107. The ring portion 107 carries an axially outwardly directed outer stop shoulder 109 between the first ring portion 107 and the second outer portion 108.

The slide member 120 carries outwardly of the spreader disc 130 as part of the outer surface of the slide stem wall 122 an axially outwardly directed inner stopping shoulder 126 on the spreader disc 130 between the spreader disc 130 and an annular groove portion 128 of the slide stem wall 122 of a diameter smaller than a diameter of the spreader disc 130. The slide stem 121 carries an axially inwardly directed outer stopping shoulder 129 between the groove portion 128 of the slide stem wall 122 and an outer portion 130 of the slide stem wall 122 outwardly of the groove portion 128 and of a greater diameter than the groove portion 128.

The outer end 124 of the passage 123 of the slide stem 121 of the slide member 130 opens into the bore 103 of the sleeve stem 101 of the sleeve member 100 such that together the passage 123 and the bore 103 provide a passageway from the channel 81 to the outlet 76.

The ring portion 107 of the sleeve stem 101 forms a radially inwardly extending annular ring between the inner stop shoulder 106 and the outer stop shoulder 109. The groove portion 128 of the slide stem 121 provides a radially outwardly extending annular slotway between the inner stopping shoulder 126 and the outer stopping shoulder 129. The groove portion 128 has an axial extent greater than the axial extent of the ring portion 107. The outer stop shoulder 109 engages the outer stopping shoulder 129 to limit sliding of the slide member 120 axially inwardly relative the sleeve member 100 in the extension condition seen in FIGS. 2 and 5. The inner stop shoulder 106 engages the inner stopping shoulder 126 to limit sliding of the slide member 120 outwardly relative to the sleeve member 100 in the retraction condition seen in FIGS. 3 and 4.

The spreader disc 130 has a radially outwardly and axially outwardly directed camming surface 131 which, when the slide member 120 is urged axially outwardly relative the sleeve member 100 will engage the inner cam surface 99 of the outer disc 73 and urge the outer disc 73 radially outwardly into engagement with the side wall 21 of the chamber 18.

The axial position of the slide member 120 relative the sleeve member 100 determines the extent to which the spreader disc 130 may engage the outer disc 73 and urge the outer disc 73 into engagement with the chamber wall 21. In an extension condition as shown in FIG. 2, the spreader disc 130 does not engage the outer disc 73 and the tendency of the outer disc 73 to form a seal with the chamber wall 21 and prevent fluid flow therepast will be a function of the extent to which the outer disc 73 engages the chamber wall 21 and, for example, the inherent bias of the outer disc 73 outwardly into the chamber wall 21. In operation of the pump 10 in a cycle of operation, the principal function of the outer disc 73 in a retraction stroke is to prevent fluid under pressure in the chamber 18 inward of the outer disc 73 from passing between the edge portion of the outer disc 73 outwardly. Thus, when there is a pressure differential across the outer disc 73 with increased pressure inwardly of the outer disc 73, it is desired that the engagement between the outer disc 73 and the chamber wall 21 is the greatest to prevent undesired fluid flow between the outer disc 73 and the chamber wall 21. In a withdrawal stroke, the inner disc 71 by its engagement with the chamber wall 21 serves to create a vacuum between the inner disc 71 and the one-way valve 16 to draw fluid in the reservoir, with outward movement of the slide member 120, past the one-way valve 16 into the chamber 18 between the one-way valve 16 and the inner disc 71. In a withdrawal stroke, once the slide member 120 assumes the extension condition, fluid in the chamber 18 captured between the inner disc 71 and the outer disc 73 is moved outwardly without a need for the engagement of the outer disc 73 with the chamber wall 21 to overcome any significant pressure differential. In a retraction stroke, fluid in the chamber 18 is pressurized between the one-way valve 16 and the inner disc 71. In the sleeve member 100 moving from the fully extended position shown in FIG. 2 towards the intermediate position in FIG. 3, pressure developed between the one-way valve 16 and the inner disc 71 will result in the slide member 120 sliding outwardly relative to the sleeve member 100 until the slide member 130 comes to assume the retraction condition in which spreader disc 130 comes engages the outer disc 73 and resistance to further relative outward sliding of the slide member 120 relative to the sleeve member 100 is resisted by the engagement of the spreader disc 130 with the outer disc 73.

Once the spreader disc 130 engages the outer disc 73 in a retraction stroke, on further inward movement of the sleeve member 100, pressure developed between the one-way valve 16 and the inner disc 71 will urge the spreader disc 130 outwardly into the outer disc 73 with the camming surface 131 on the spreader disc 130 engaging the inner cam surface 99 on the outer disc 73 thus urging the outer disc 73 outwardly into the side wall 21 of the chamber 18. The slide member 120 is maintained in the retraction condition until the sleeve member 100 is moved inwardly to the fully retracted position shown in FIG. 4. In an extension stroke from the position shown in FIG. 4, with first movement of the sleeve member 100 outwardly relative the body 12, the sleeve member 100 moves outwardly relative the slide member 120 until the stop shoulder 109 on the sleeve stem 101 engages the stopping shoulder 129 on the slide stem 102 as outward movement of the slide member 120 is resisted by a vacuum created between the inner disc 71 and the one-way valve 16.

Thus, with movement of the sleeve member 100 outwardly from the fully retracted position of FIG. 4 with the slide member 120 and sleeve member 100 in a retraction condition, the sleeve member 100 moves relative to the slide member 120 until an extension condition is achieved when the stop shoulder 109 on the sleeve member 100 engages the stopping shoulder 129 on the slide member 120 as seen in FIG. 5. In movement of the sleeve member 100 outwardly with the slide member 120 in the extension condition, a vacuum is created between the one-way valve 16 and the inner disc 71 which draws fluid from the reservoir past the one-way valve 16 into the chamber 18 between the one-way valve 16 and the inner disc 71.

In the first preferred embodiment, the slide stem 121 is coaxially slidable in the bore 103 of the sleeve member 100 and provides a lost motion link between the slide member 120 and the sleeve member 100. Other mechanical arrangements may provide the same lost motion link.

A cycle of operation is now described in which the sleeve member 100 is moved from the extended position of FIG. 2 to the intermediate position of FIG. 3 and then to the retracted position of FIG. 4 in a fluid discharging retraction stroke; and then from the retracted position of FIG. 4 to the intermediate position of FIG. 5 and then to the extended position of FIG. 2 in a fluid charging extension stroke. The extension stroke and the retraction stroke together comprise a complete cycle of operation.

In moving from the extended position of FIG. 2 toward the retracted position of FIG. 4, when the sleeve member 100 and slide member 120 are in a retraction condition as seen in FIG. 3, as they move inwardly, fluid within the chamber 18 is compressed between the inner disc 71 and the one-way inlet valve 16. The one-way inlet valve 16 closes and as pressure is developed within the chamber 18, the inner disc 71 deflects to permit fluid to pass outwardly past the inner disc 71 to between the inner disc 71 and the outer disc 73 and hence via the channel 81 to the passage 123 out the slide outlet 176 into the bore 109 and through the bore 109 to the outlet 76.

During some portion of the extension stroke, the sleeve member 100 moves outwardly relative the slide member 130 from the retraction condition to the extension condition. The outer disc 73 engages the chamber wall 21 of the chamber 18 so as to prevent fluid flow inwardly therepast. As a result of the sleeve member 100 moving outwardly relative to the slide member 120, a vacuum is created within the chamber 18 inwardly of the outer disc 73 between the outer disc 73 and the inner disc 71. This vacuum will tend to draw fluid inwardly from the outlet 76 via the bore 103 and passage 123 and the channel 81 into the chamber 18. This vacuum within the chamber 18 will also be applied to the inner disc 71 and if the inner disc 71 disengages from the side wall 21, this vacuum will be applied to the one-way valve 16 and will attempt to deflect the flexing disc 41 of the one-way valve 16 to draw fluid into the chamber 18 from the reservoir 60. Having regard to the nature of the fluid, the resistance of fluid to flow through the outlet 76, the bore 103, the passage 123 and the channel 81 and the size and resiliency of the first disc 71 and the flexing disc 41, the vacuum created in the chamber 18 will draw fluid back from the outlet 76 and/or draw fluid from the reservoir. In one preferred configuration, the flexing disc 41 is biased into the wall 42 of the inlet tube 35 such that with relative outward sliding of the sleeve member 100 relative the slide member 120 in the extension stroke, the vacuum within the chamber 18 will not be sufficient to open the one-way valve 16 to permit fluid flow therepast outwardly into the chamber 18 and, as a result, there will be drawback of fluid from the outlet 76.

In the extension stroke, when the sleeve member 100 and the slide member 120 are in an extension condition as seen in FIG. 5, with outward movement of the sleeve member 100 and the slide member 120 together, the inner disc 71 sealably engages the chamber wall 21 of the chamber 18 and a vacuum is created in the chamber 18 inwardly of the inner disc 71 which vacuum operates on the one-way valve 16 so as to open the one-way valve 16 and draw fluid from the reservoir 60 into the chamber 18.

In FIG. 1, the activating lever 188 is biased so as to urge the piston 14 to assume the extended position under the bias of the spring 102 as shown in dashed lines in FIG. 1. As shown only in FIG. 4, biasing of the piston 14 toward the fully extended position can be accommodated by a coil spring 50 disposed between the body 12 and the sleeve member 100 coaxially about the axis 23 and biasing the sleeve member 100 outwardly from the body 12. As seen in FIG. 4, the body 12 includes an outer tube 51 having a stop flange 52 at its outer end. An annular cavity 53 is defined between the outer tube 51 and inner tube 17. The sleeve member 100 includes a guide tube 54 open at an inner end 53 and carrying annular flanges 56 and 57 to engage the inner surface 58 of the outer tube 51 of the body 12 to assist in coaxially locating the sleeve member 100 within the body 12. The outermost flange 57 serves as a stop flange to engage the stop flange 52 on the outer tube 51 of the body 12 to prevent the sleeve member 100 from being moved outwardly from the body 12 beyond the fully extended position. As seen in FIG. 4, the coil spring 50 is disposed in the annular cavity 53 in between the guide tube 54 of the sleeve member 100 and the inner tube 17 of the body 12. The body 12 preferably is a unitary element formed entirely of plastic preferably by injection molding. The sleeve member 100 is illustrated as being made from two elements, namely a center element 140 and a skirt element 142 each preferably by injection molded foam plastic and then secured together.

Figure 6:
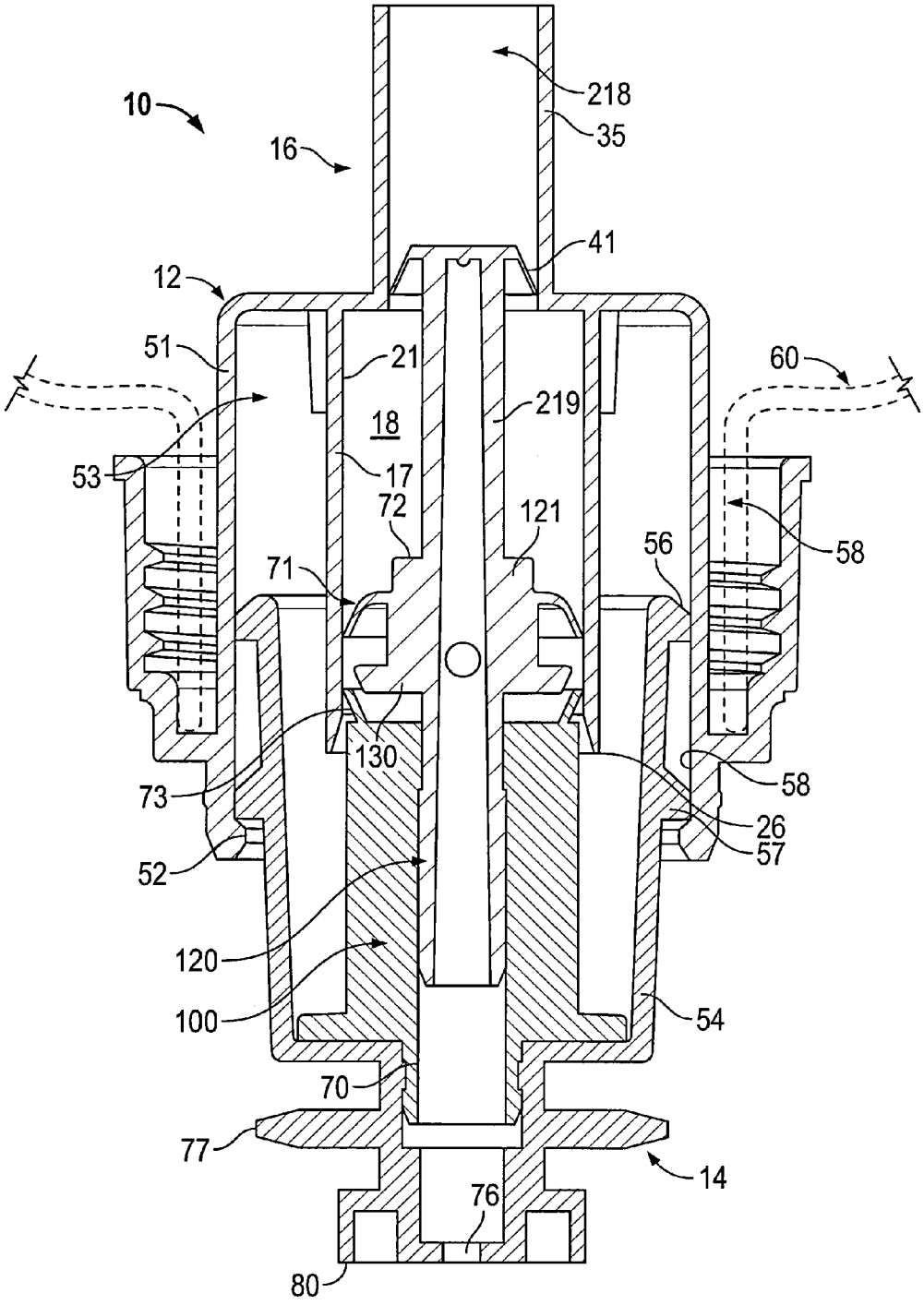
FIG. 6 is a schematic cross-sectional side view of a pump assembly in accordance with a second embodiment of the present invention during an extension stroke with the slide member in an extension condition.

Reference is made to FIG. 6 which shows a second embodiment of a pump assembly 10 in accordance with the present invention. The second embodiment shown in FIG. 6 is identical to the first embodiment as illustrated in FIG. 2 with the exception that the one-way valve arrangement illustrated in FIG. 1 and characterized by the shoulder button 40 carrying the flexing disc 41 has been replaced by a one-way valve 16 providing a separate stepped piston arrangement. As seen in FIG. 6, the inlet tube 35 has been extended inwardly and provides a separate chamber 218 within which the flexing disc 41 is coaxially slidably received and with the flexing disc 41 carried on an inward extension 219 of the slide stem 121. With the diameter of the chamber 218 smaller than the diameter of the chamber 18, with inward movement of the slide member 120 relative the body 12, fluid is discharged outwardly past the inner disc 71 and with outward movement of the slide member 120 relative the body 12, fluid is drawn into the chamber 18 past the disc 41. The embodiment illustrated in FIG. 6 has the advantage that, in a retraction stroke, with the slide member 120 in an extended condition, movement of the slide member 120 inwardly is resisted both by pressure created inward of the disc 41 and inward of the disc 71 which pressures assist in urging the slide member 120 outwardly into engagement with the outer disc 73.

Figure 7:
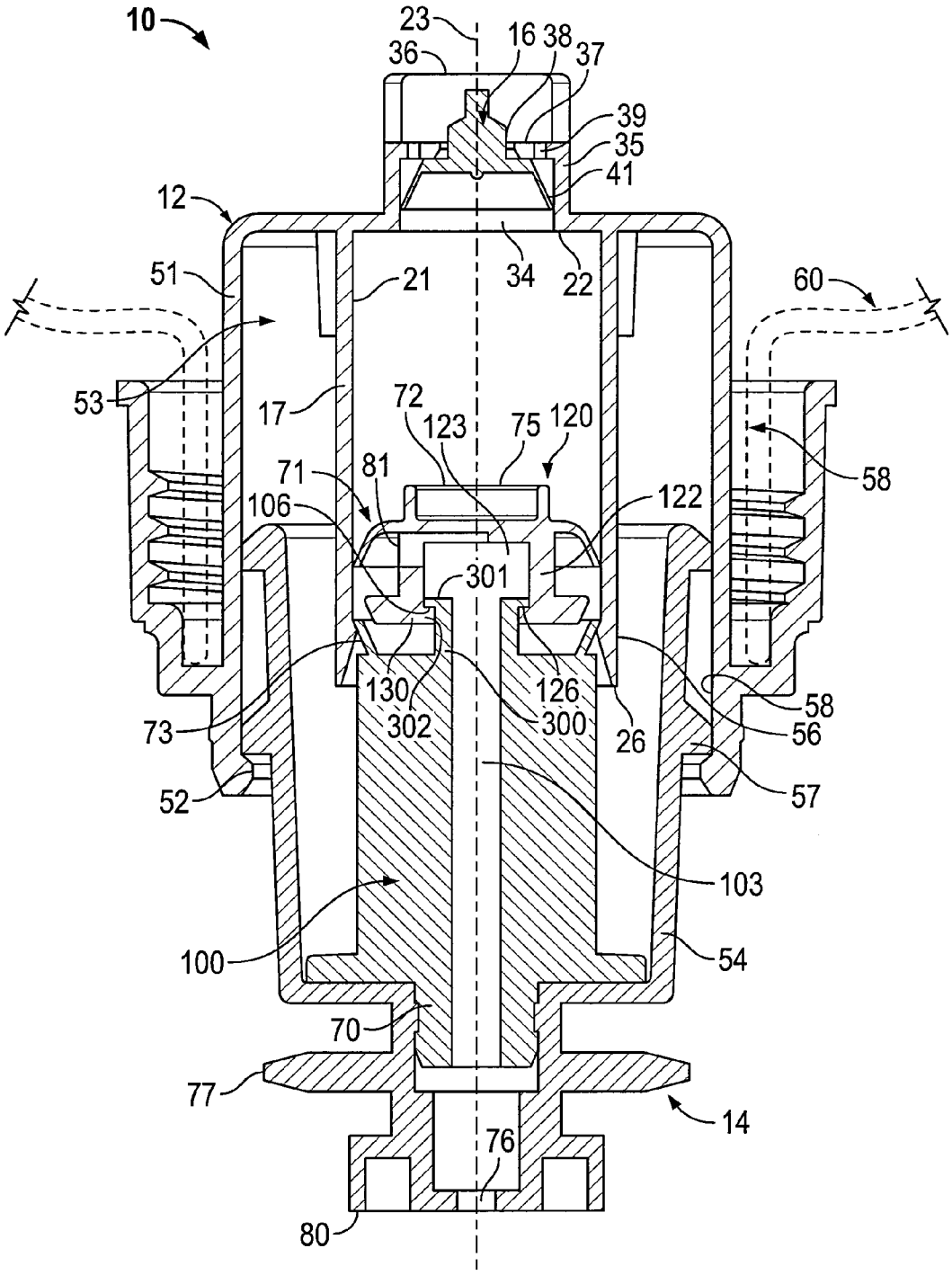
FIG. 7 is a schematic cross-sectional side view of a pump assembly in accordance with a third embodiment of the present invention during an extension stroke with the slide member in an extension condition.

Reference is made to FIG. 7 which illustrates a third embodiment of a pump assembly 10 in accordance with the present invention. The third embodiment of FIG. 7 is substantially identical to the first embodiment as shown in FIG. 2, however, with modification as to the lost link mechanism by which the slide body 120 is coaxially slidable relative to the sleeve member 100 for limited axial sliding. As seen in FIG. 7, the sleeve member 100 includes about its bore 103 an axial inward extension tube 300 which has an enlarged flange 301 at its inner end providing an axially outwardly directed stopping shoulder 106. The slide member 120 is provided with its passage 123 to be of a diameter to receive the flange 301 of the extension tube 300 coaxially therein with the slide member 120 having at its outer end a radially inwardly directed flange 302 carrying an inwardly directed stop surface 126 to engage the stopping surface 106 on the sleeve member 100 and limit relative inward sliding of the slide member 120 in the extension condition as shown in FIG. 7. From the extension condition shown in FIG. 7, the slide member 120 can be slid axially outwardly relative to the sleeve member 100 to a retraction condition in which the spreader disc 130 engages the outer disc 73. A channel 81 is shown in FIG. 7 as extending through the slide stem 122 and axially inwardly such that in all relative positions of the slide member 120 and the sleeve member 100, communication is provided from the channel 81 and passage 123 to the bore 103 of the sleeve member 100 such that fluid may flow to the outlet 76.

Figure 8:
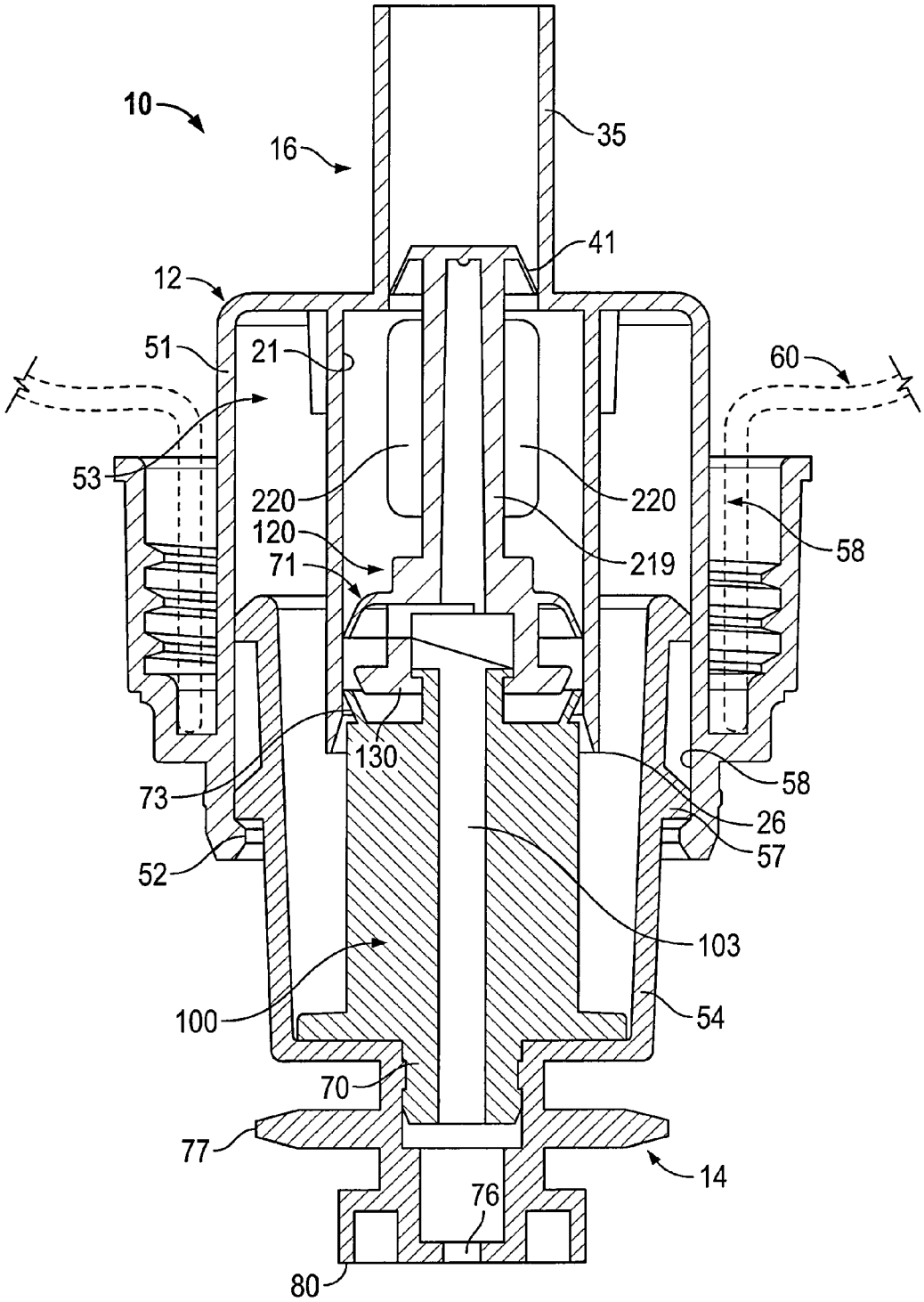
FIG. 8 is a schematic cross-sectional side view of a pump assembly in accordance with a fourth embodiment of the present invention during an extension stroke with the slide member in an extension condition.

Reference is made to FIG. 8 which shows a fourth embodiment of a pump assembly 10 in accordance with the present invention which is identical to the third embodiment shown in FIG. 7, however, in which a one-way valve mechanism of the type illustrated in FIG. 6 is coupled to the slide member 120. In FIG. 8, axial extending guide vanes 220 are provided on the extension 219 of the slide member 120 which extends into the inlet tube 35 as can be advantageous to maintain the slide body coaxially aligned within the chamber 18.

A pump in accordance with the present invention may be used either with bottles which are vented or bottles which are not vented. Various venting arrangements can be provided so as to relieve any vacuum which may be created within the bottle 60. Alternatively, the bottle 60 may be configured, for example, as being a bag or the like which is readily adapted for collapsing.

A pump in accordance with the present invention is preferably adapted for use in an arrangement as illustrated in FIG. 1 in which the bottle 60 is disposed above the chamber 18 having its open end opening downwardly. However, this is not necessary. The arrangement in FIG. 1 could be inverted and fluid provided to the inlet tube 35 via a dip tube or the bottle 60 may be collapsible.

In the preferred embodiment illustrated in FIGS. 2 to 5, it is preferred that to prevent leakage as, for example, during storage before use or possibly between strokes, that the sleeve member 100 be in a retracted position as seen in FIG. 5 with the slide member 120 in a retraction condition. A suitable removable storage cap (not shown) may hold the piston 14 in such a condition coupled to a fluid filled reservoir. As well, an activation mechanism can be configured to hold the piston 14 between cycles of operation to resist leaking with the sleeve member 100 in a retracted position and slide member 120 in a retraction condition.

Figure 9:
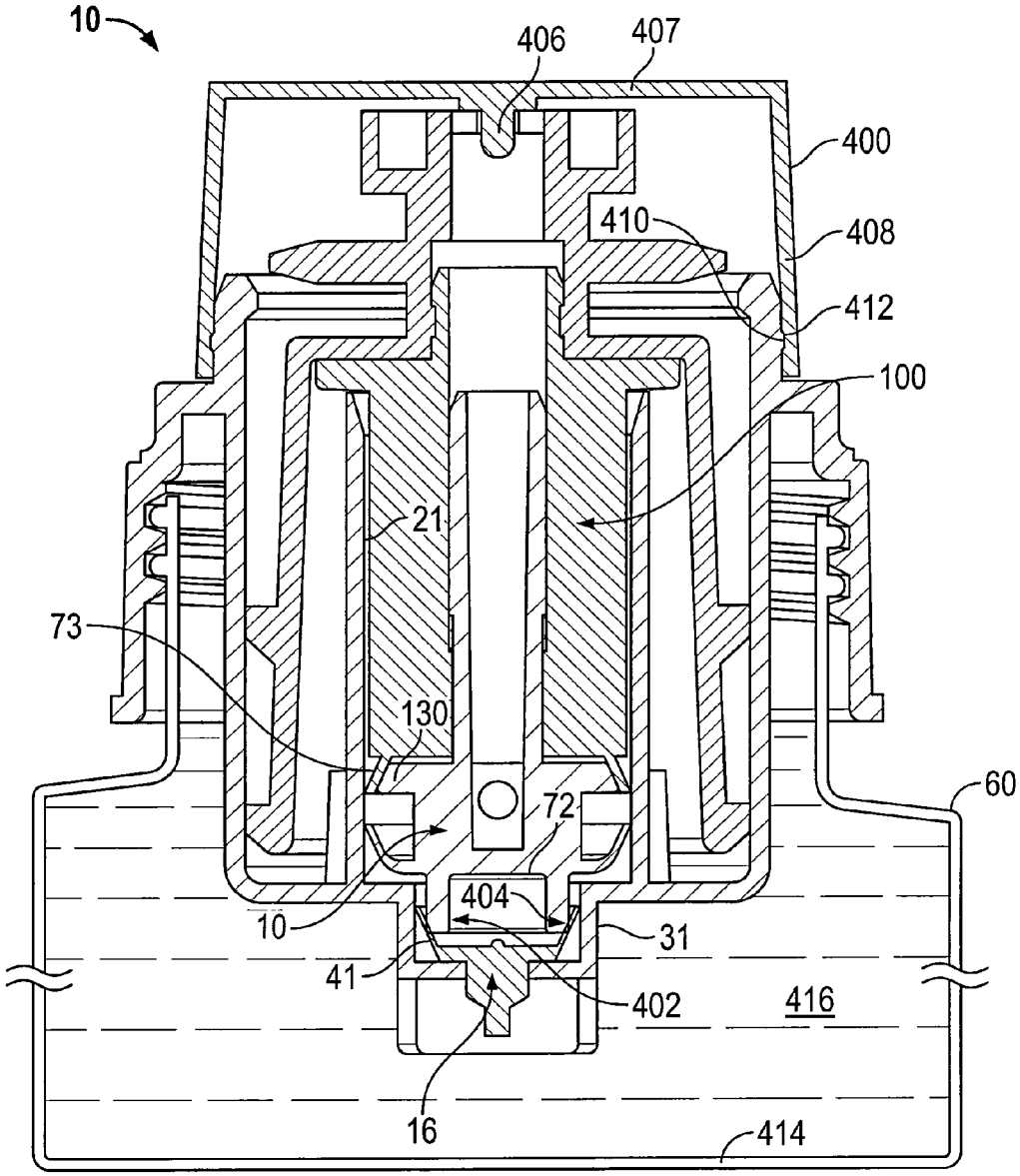
FIG. 9 is a schematic cross-sectional side view of a pump assembly in accordance with a fifth embodiment of the present invention at the end of a retraction stroke with the piston sleeve member in a fully retracted position and the slide member in a retraction condition.

Reference is made to FIG. 9 which illustrates a fifth embodiment of the pump assembly 10 in accordance with the present invention coupled to a sealed bottle 60 and with the pump held in a closed retracted position by a removable cap 400. The pump assembly 10 of FIG. 9 is substantially identical to that illustrated in FIGS. 2 to 5, however, without an internal spring such as spring 50 shown in FIG. 4 and with the innermost end 72 of the slide member 120 adapted to extend upwardly into the inlet tube 35 as an annular ring 402 which carries a frustoconical camming surface 404 to engage the disc 41 of the one-way valve 16 and urge the disc 41 outwardly into engagement with the wall 42 of the inlet tube 35. The cap 400 is shown as carrying a central button 406 on an end wall 107 adapted to be engaged in the outlet 76 of the piston slide member 120 and with the cap 400 to have an annular side wall 408 which engages with the piston chamber-forming body 12 in a snap relation by reason of an annular shoulder 410 carried on the body 12 being engaged in a complementary snap groove 412 on the cap 400. FIG. 9 schematically illustrates the bottle 60 as sitting on its base 414 and filled with fluid 416. In the storage position shown, the spreader disc 130 engages the outer disc 73 to urge it outwardly to form a good seal with the chamber wall 21 and, as well, the camming surface 404 of the ring 402 engages the disc 41 of the one-way valve 16 to urge it outwardly and form a seal. The arrangement illustrated in FIG. 9 provides an advantageous configuration for storage in which fluid flow inwardly to or outwardly from the bottle 60 is substantially prevented.

While the invention has been described with reference to preferred embodiments, many variations and modifications will now occur to persons skilled in the art. For a definition of the invention, reference is made to the appended claims.

We claim:

1. A pump for dispensing liquid from a reservoir comprising:

piston chamber-forming member having a chamber disposed about an axis, the chamber having a diameter, a chamber wall, an inner end and an open outer end, the inner end of the chamber in fluid communication with the reservoir, a one-way valve between the reservoir and the chamber permitting fluid flow through the inner end of said chamber, only from the reservoir to the chamber, a piston sleeve member slidably received in the chamber of the piston chamber-forming member for reciprocal axial inward and outward movement therein in a stroke of movement between an extended position and a retracted position, said sleeve member having an axially extending hollow sleeve stem having a central bore therethrough from an inner end to an outlet proximate an outer end, an outer disc on the sleeve stem and extending radially outwardly from the sleeve stem circumferentially thereabout to engage the chamber wall to form a seal therewith against fluid flow therepast, the outer disc having a cam surface annularly thereabout outwardly of the sleeve stem, a piston slide member having an axially extending hollow slide stem having a central passage closed at an inner end and open at an outer end, an inner disc on the slide stem extending radially outwardly from the slide stem circumferentially thereabout proximate the inner end of the slide stem, a spreader disc on the slide stem spaced axially outwardly from the inner disc and extending radially outwardly from the slide stem circumferentially thereabout, an inlet located on the slide stem between the inner disc and the spreader disc in communication with the passage, the slide member coupled to the sleeve member for limited coaxial sliding movement of the slide member relative the sleeve member between an extension condition and a retraction condition with the slide stem coaxially disposed relative the bore, the passage in communication with the bore, and the spreader disc located in the chamber inwardly of the outer disc, the inner disc engaging the chamber wall axially inwardly of the spreader disc to substantially prevent fluid flow in the chamber past the inner disc in an inward direction but with the inner disc elastically deforming away from the chamber wall to permit fluid flow in the chamber past the inner disc in an outward direction, the spreader disc having a camming surface in opposition to the cam surface of the outer disc, in the extension condition the camming surface of the spreader disc is axially spaced from the cam surface of the outer disc, in the retraction condition the camming surface of the spreader disc engaging the cam surface of the outer disc to urge the edge portion of the outer disc radially outwardly into the chamber wall.

2. A pump as claimed in claim 1 wherein the slide member is coupled to the sleeve member with the slide stem coaxially slidably received in the bore and the outer end of the passage opening into the bore.

3. A pump as claimed in claim 1 wherein the slide member is coupled to the sleeve member with an inner portion of the sleeve stem coaxially slidable in the passage.

4. A pump as claimed in claim 1 wherein:

a cycle of operation comprises moving in a retraction stroke from the extended position to the retracted position and moving in a withdrawal stroke from the retracted position to the extended position, in the withdrawal stroke a vacuum is created in the chamber between the inner disc and the one-way valve by which both (a) the slide member is moved relative the sleeve member to the extension condition and (b) fluid is drawn from the reservoir past the one-way valve to between the inner disc and the one-way valve, in the retraction stroke pressure is created in the chamber between the inner disc and the one-way valve by which both (a) the slide member is moved relative the sleeve member to the retraction condition and (b) fluid is discharged from between the inner disc and the one-way valve past the inner disc to between the inner disc and the outer disc and via the inlet, the passage and the bore out the outlet.

5. A pump as claimed in claim 1 wherein:

at the end of a withdrawal stroke and the beginning of a retraction stroke the sleeve member is in the extended position with the slide member in the extension condition, and at the end of a retraction stroke and the beginning of a withdrawal stroke the sleeve member is in the retracted position with the slide member in the retraction condition.

6. A pump as claimed in claim 1 wherein in the retraction stroke, the pressure created in the chamber between the inner disc and the one-way valve urges the slide member axially outwardly relative the sleeve member to force the camming surface of the spreader disc axially into engagement with the cam surface of the outer disc thereby urging the edge portion of the outer disc radially outwardly into the chamber wall increasing the extent to which the engagement of the outer disc with the chamber wall can prevent fluid flow outwardly therepast.

7. A pump as claimed in claim 1 wherein:

the cam surface is directed axially inwardly and radially inwardly.

8. A pump as claimed in claim 1 wherein:

the camming surface is directed axially outwardly and radially outwardly.

9. A pump as claimed in claim 1 wherein:

the cam surface is directed axially inwardly and radially inwardly, and the camming surface is directed axially outwardly and radially outwardly.

10. A pump as claimed in claim 1 wherein in the cycle of operation includes a rest position when the pump is not in use, wherein in the rest position the sleeve member is in the retracted position and the slide member is in the retraction condition.

11. A pump as claimed in claim 1 wherein the pump assumes a storage position in which the pump is stored coupled to the reservoir filled with fluid, wherein in the storage position the sleeve member is in the retracted position and slide member is in the retraction condition.

12. A pump as claimed in claim 1 including an axially outwardly directed inward stop shoulder on the sleeve member and an opposed axially inwardly directed inward stopping shoulder on the slide member to limit inward movement of the slide member relative the sleeve member in the extension condition by abutment between the inward stop shoulder and the inward stopping shoulder.

13. A pump as claimed in claim 1 including an axially inwardly directed outward stop shoulder on the sleeve member and an opposed axially outwardly directed outward stopping shoulder on the slide member to limit outward movement of the slide member relative the sleeve member in the retraction condition by abutment between the outward stop shoulder and the outward stopping shoulder.

14. A pump as claimed in claim 1 including a spring member biasing the sleeve member to the extended position.

15. A pump as claimed in claim 1 wherein:

the sleeve member and the slide member each being generally cylindrical in cross-section, each of the inner disc, spreader disc and outer disc being circular;

the inner disc having a circumferential resilient peripheral edge portion which engages the chamber wall to form a seal therewith against fluid flow inwardly therepast but elastically deforming away from the chamber wall to permit fluid flow in the chamber past the inner disc in an outward direction, and the outer disc having a circumferential resilient peripheral edge portion which engages the chamber wall to form a seal therewith against fluid flow therepast.

16. A pump as claimed in claim 1 wherein sleeve member extending outwardly from the open outer end of the piston chamber-forming member to locate the outlet on the sleeve member outwardly of the open outer end of the piston chamber-forming member.

17. A pump as claimed in claim 1 wherein:

in the withdrawal stroke the vacuum created in the chamber between the inner disc and the one-way valve firstly moves the slide member relative the sleeve member to the extension condition and then subsequently draws fluid from the reservoir past the one-way valve to between the inner disc and the one-way valve.

18. A pump as claimed in claim 1 wherein:

in the retraction stroke the pressure created in the chamber between the inner disc and the one-way valve firstly moves the slide member relative the sleeve member to the retraction condition and subsequently discharges fluid from between the inner disc and the one-way valve past the inner disc to between the inner disc and the outer disc and via the inlet, the passage and the bore out the outlet.

19. A pump as claimed in claim 1 wherein:

in the withdrawal stroke the movement of the slide member relative the sleeve member from the retraction condition to the extension condition creates a vacuum in the chamber between the inner disc and the outer disc which draws fluid back into the chamber between the inner disc and the outer disc from the outlet via the inlet, passage and bore.

20. A pump as claimed in claim 18 wherein:

in the withdrawal stroke the movement of the slide member relative the sleeve member from the retraction condition to the extension condition creates a vacuum in the chamber between the inner disc and the outer disc which draws fluid back into the chamber between the inner disc and the outer disc from the outlet via the inlet, passage and bore.

* * * * *